US009793636B2

(12) United States Patent
France et al.

(10) Patent No.: US 9,793,636 B2
(45) Date of Patent: Oct. 17, 2017

(54) INSULATING BODY FOR PLUGGABLE CONNECTOR

(71) Applicant: ABB TECHNOLOGY AG, Zurich (CH)

(72) Inventors: Philippe France, Chazelles sur Lyon (FR); Romain Villard, Tassin la Demi Lune (FR)

(73) Assignee: ABB SCHWEIZ AG, Zurich (CH)

( * ) Notice: Subject to any disclaimer, the term of this patent is extended or adjusted under 35 U.S.C. 154(b) by 0 days.

(21) Appl. No.: 14/855,333

(22) Filed: Sep. 15, 2015

(65) Prior Publication Data

US 2016/0079698 A1 Mar. 17, 2016

(30) Foreign Application Priority Data

Sep. 16, 2014 (FR) ..... 14 58738

(51) Int. Cl.
*H01R 13/405* (2006.01)
*H01R 9/24* (2006.01)
*H01R 13/436* (2006.01)

(52) U.S. Cl.
CPC ..... *H01R 13/405* (2013.01); *H01R 9/2491* (2013.01); *H01R 13/4361* (2013.01)

(58) Field of Classification Search
CPC .. H01R 13/405; H01R 13/514; H01R 13/515; H01R 13/518; H01R 13/501; H01R 13/42; H01R 13/5213; H01R 13/5216; H01R 13/5816; H01R 13/2608; H01R 13/2691; H01R 9/16; H01R 9/223; H01R 9/24
USPC ..... 439/709, 595, 712, 715, 331, 689, 693, 439/372, 465, 713, 906, 718, 892, 717, 439/724, 725, 731, 732, 733.1
See application file for complete search history.

(56) References Cited

U.S. PATENT DOCUMENTS 3,505,730 A * 4/1970 Nelson ..... H01J 23/27 228/903
3,904,265 A * 9/1975 Hollyday ..... H01R 13/516 439/469
5,211,706 A * 5/1993 Polgar ..... H01R 13/506 439/464
5,696,351 A * 12/1997 Benn ..... G02B 6/4477 174/138 F (Continued)

FOREIGN PATENT DOCUMENTS

WO 2006120150 A1 11/2006

*Primary Examiner* — Abdullah Riyami
*Assistant Examiner* — Harshad Patel
(74) *Attorney, Agent, or Firm* — Cantor Colburn LLP

(57) ABSTRACT

The object of the present invention is an insulating body (1) for a pluggable connector (10) intended to be connected to a junction block (100), said insulating body (1) comprising a housing (2) for conductive parts (11, 12) comprising a connection terminal (11) for a conductive wire intended to be connected to the pluggable connector (10), said housing (2) comprising a support portion (6) for the connection terminal (11) and being arranged to open on a side wall (3) of the insulating body (1) via an aperture (4) arranged on said side wall (3), the insulating body (1) comprising wedging means (7), said wedging means (7) being disposed in whole or in part within a portion of the housing (2) situated facing the support portion (6) of the housing (2).

9 Claims, 4 Drawing Sheets

(56) References Cited

U.S. PATENT DOCUMENTS

| | | | | | |
|---|---|---|---|---|---|
| 5,839,911 | A * | 11/1998 | Dinkel | H01R 13/582 | 439/470 |
| 6,146,217 | A * | 11/2000 | Osada | H01R 4/4836 | 439/441 |
| 6,336,824 | B1 * | 1/2002 | Sorig | H01R 4/4836 | 439/395 |
| 6,485,333 | B1 * | 11/2002 | Shinchi | H01R 13/504 | 174/77 R |
| 6,695,639 | B2 * | 2/2004 | Castaldo | H01R 24/28 | 439/465 |
| 7,048,581 | B1 | 5/2006 | Wong | | |
| 8,113,858 | B1 * | 2/2012 | Chiang | H01R 4/4845 | 439/188 |
| 8,480,441 | B2 * | 7/2013 | Wu | H01R 4/4836 | 439/491 |
| 8,851,920 | B2 * | 10/2014 | Wu | H01R 4/4827 | 439/441 |
| 9,083,090 | B2 | 7/2015 | Wu et al. | | |
| 2009/0221191 | A1 | 9/2009 | Bentler et al. | | |
| 2012/0064780 | A1 * | 3/2012 | Wu | H01R 9/2475 | 439/712 |

* cited by examiner

INSULATING BODY FOR PLUGGABLE CONNECTOR

CROSS REFERENCE TO RELATED APPLICATION

This application is related to and claims the benefit of French Patent Application Number 14/58738 filed on 16 Sep. 2014, the contents of which are herein incorporated by reference in their entirety.

TECHNICAL FIELD

The present invention relates to the field of electric connection between a pluggable connector and a junction block.

Particularly, the disclosure concerns an insulating body for a pluggable connector as well as a pluggable connector comprising such an insulating body.

BACKGROUND

It is known to dispose insulating bodies for pluggable connectors presenting dimensions and in particular different widths.

Each insulating body comprises a housing for conductive parts.

These conductive parts comprise generally a connection socket intended to carry out an electrical contact with a connection terminal of a junction block and a connection terminal for a conductive wire.

The housing opens on an aperture arranged on a side wall of the insulating body.

The conductive parts are maintained in the housing of an insulating body of a pluggable connector considered between a support wall of the housing and a side wall of an insulating body of an adjacent pluggable connector and bearing on the side wall of the considered pluggable connector so as to close the aperture of the housing.

Consequently, in order to be enclosed within the housing, the width of the conductive parts has to correspond substantially to the width of the housing measured between the support wall of the housing and the aperture of the housing.

Thus, there are as many different types of conductive parts as different types of insulating bodies for pluggable connectors.

Nevertheless, it may be advantageous to use, for optimizing the production of pluggable connectors with different widths, the same type of conductive parts presenting the same width.

However, in the case where conductive parts originally provided for the insulating body of a pluggable connector with a determined width are used in an insulating body intended to form another wider pluggable connector then conductive parts are no longer enclosed between the support wall of the housing of this insulating body and the side wall of an insulating body of an adjacent pluggable connector.

This width difference generates a residual clearance of the conductive parts within the housing of the insulating body of the pluggable connector.

This residual clearance may create a disconnection of the conductive wire of the connection terminal from the conductive parts.

BRIEF SUMMARY

The present invention aims to resolve all or part of the above-mentioned drawbacks.

To this end, the invention concerns an insulating body for a pluggable connector intended to be connected to a junction block, said insulating body comprising a housing for conductive parts comprising a connection terminal for a conductive wire intended to be connected to the pluggable connector, said housing comprising a support portion for the connection terminal and being arranged to open on a side wall of an insulating body via an aperture arranged on said side wall, the insulating body comprising wedging means, said wedging means being disposed, in whole or in part, within a portion of the housing situated facing the support portion of the housing.

This disposition allows adapting the dimensions of an insulating body to the dimensions of connection terminals that present dimensions lower than those of the connection terminal initially provided for the dimensions of such an insulating body.

Thus, the residual clearance of the connection terminals inside the housing of the insulating body of the pluggable connector is further limited.

According to an aspect of the invention, the wedging means are removable.

This disposition allows facilitating the introduction of the conductive parts in the housing.

According to an aspect of the invention, the wedging means and the support portion of the housing present a contour with a determined shape intended to cooperate in a complementary way with a contour of the connection terminal.

This disposition allows further reducing the residual clearance that may exist between the insulating body and the connection terminal.

According to an aspect of the invention, the wedging means are secured to a plate with a determined thickness arranged to bear on the side wall of the insulating body.

The thickness of the plate allows compensating for the spacing which could have been created between two adjacent pluggable connectors after insertion in the junction block. The thus formed pluggable connectors adapt therefore to the pitch of the junction block and two adjacent pluggable connectors may thus bear on each other.

According to an aspect of the invention, the plate is linked to an upper wall adjacent to the side wall of the insulating body via a linking element so as to be movable between:

- a first position wherein the wedging means are disposed outside the housing and the plate is disposed at a distance from the side wall of the insulating body, and
- a second position wherein the wedging means are disposed in whole or in part within the housing and the plate bears on the side wall of the insulating body.

This disposition allows linking in a safe way the wedging means to the insulating body and to the plate in order not to misplace them and avoiding compatibility problems between the wedging means and the housing of the insulating body.

According to an aspect of the invention, the linking element is linked to the upper wall by a pivot link.

According to an aspect of the invention, the linking element comprises a tenon arranged to cooperate with at least one mortise disposed on the upper wall of the insulating body.

This disposition allows preserving the pivot link from possible stresses during the switching of the plate between its first and its second position.

According to an aspect of the invention, the plate comprises at least one tenon arranged to cooperate with at least one mortise disposed on the side wall of the insulating body.

This disposition allows maintaining the plate in its second position.

According to an aspect of the invention, the plate presents a contour of which shape is arranged to bypass the tenons protruding from the side wall of the insulating body.

This disposition allows avoiding drilling the plate.

The disclosure also provides a pluggable connector comprising an insulating body as described previously and conductive parts including:

- a connection terminal intended to the connection of a conductive wire, and
- a connection socket intended to the connection of a connection terminal of a junction block, the connection terminal being electrically linked to the connection socket.

BRIEF DESCRIPTION OF THE DRAWINGS

Anyway, the invention will be well understood through the following description, with reference to the annexed schematic drawing which represents, for non limiting examples, an insulating body and a pluggable connector according to the invention.

DETAILED DESCRIPTION

Figure 1:
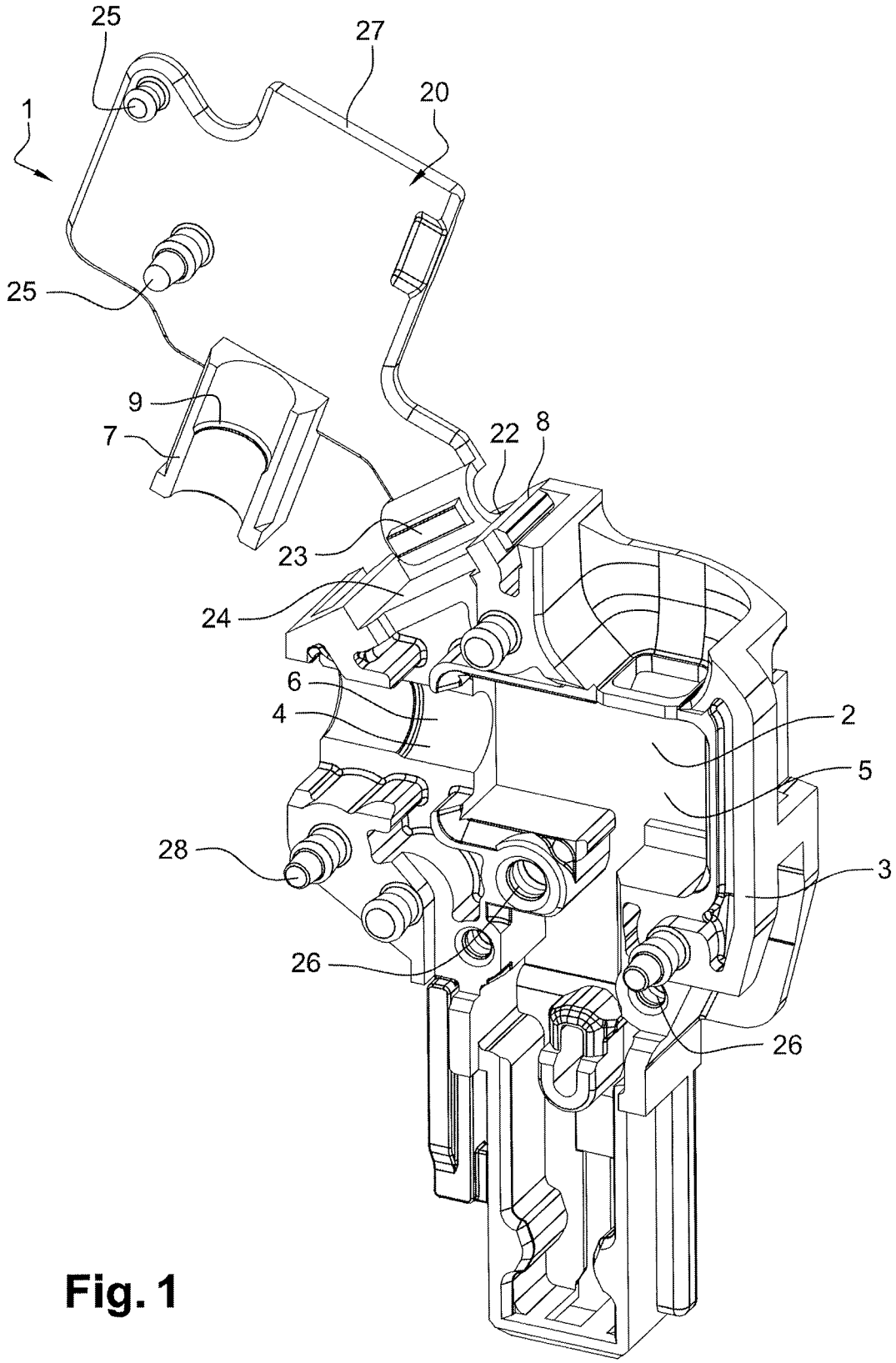
FIG. 1 shows a perspective view of an insulating body in open position of a first type-pluggable connector according to the invention.
Figure 2:
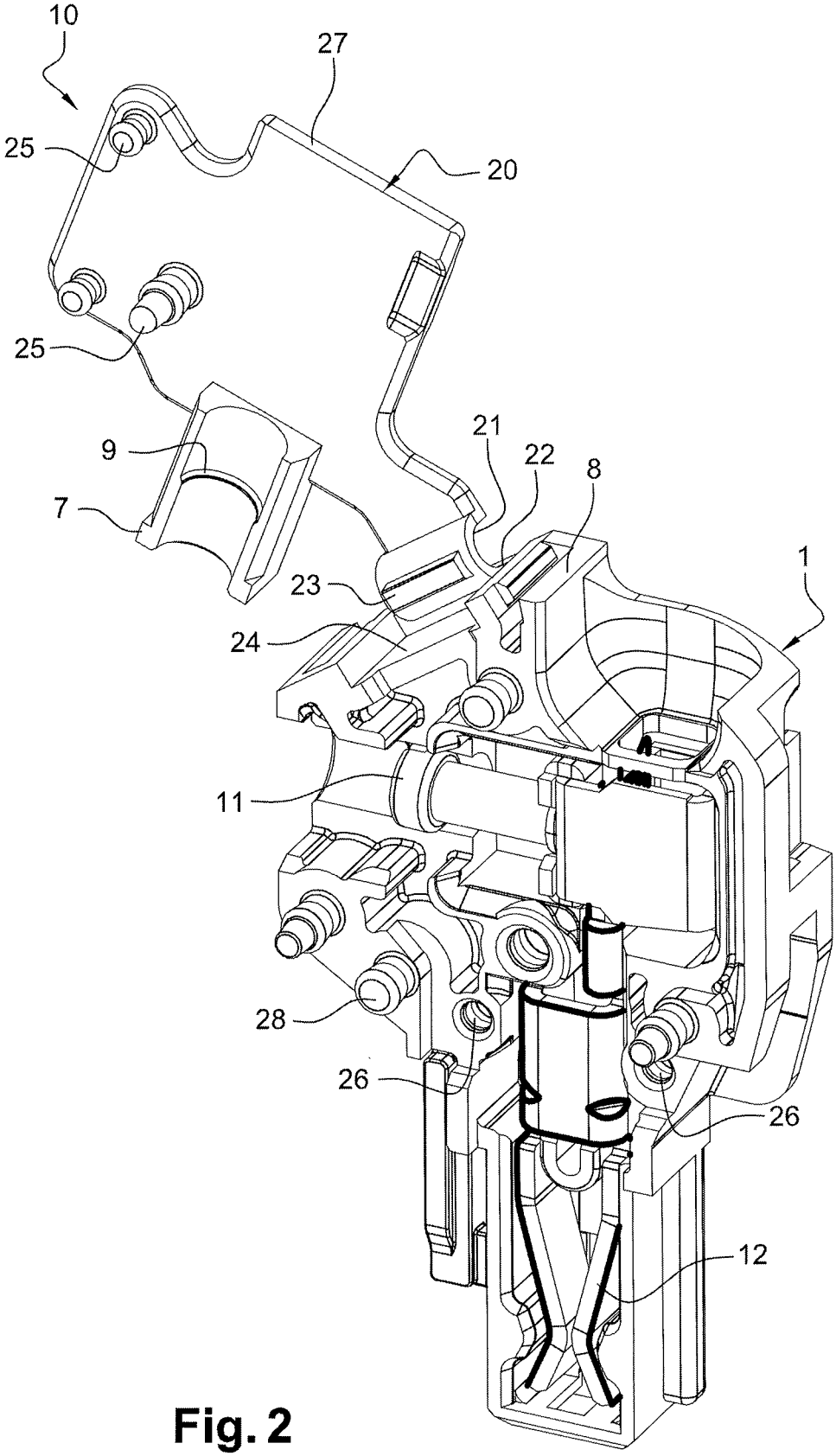
FIG. 2 shows a perspective view of a second type-pluggable connector comprising an insulating body according to the invention.
Figure 3:
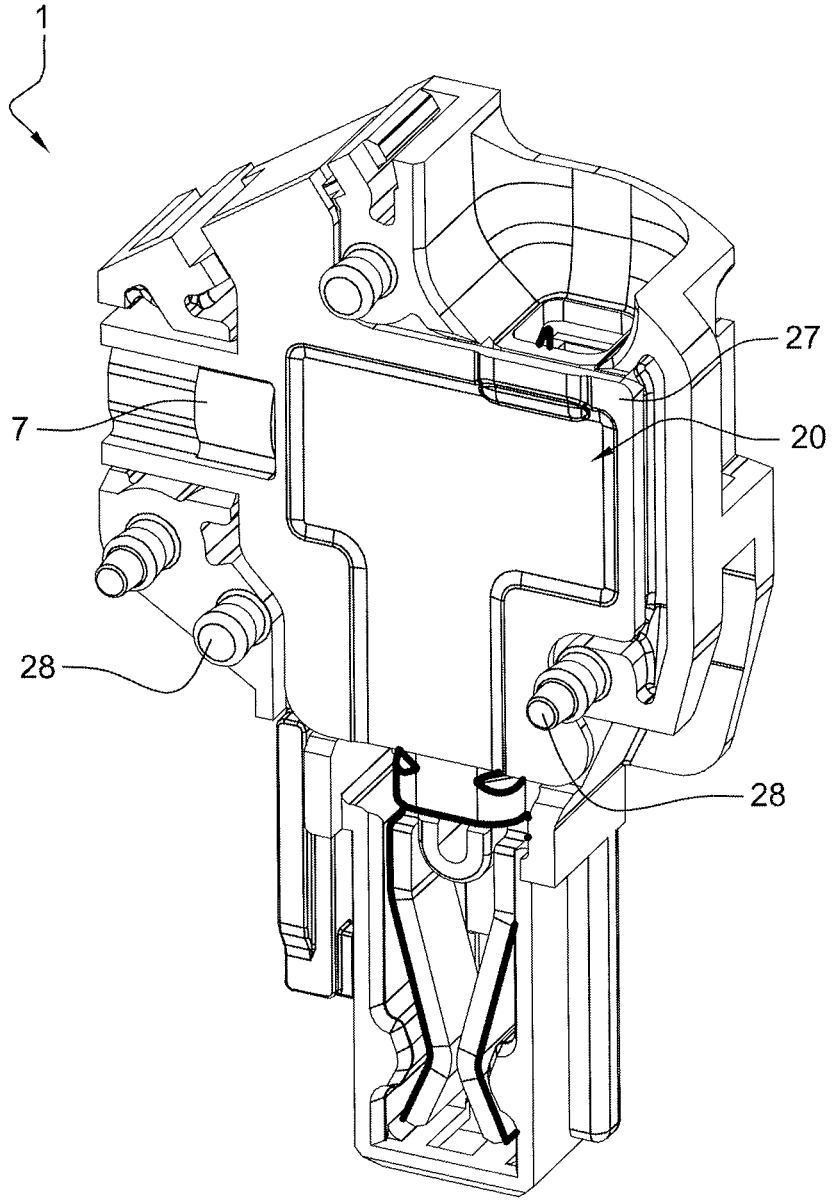
FIG. 3 shows a perspective view of the insulating body of FIG. 1 in closed position.
Figure 4:
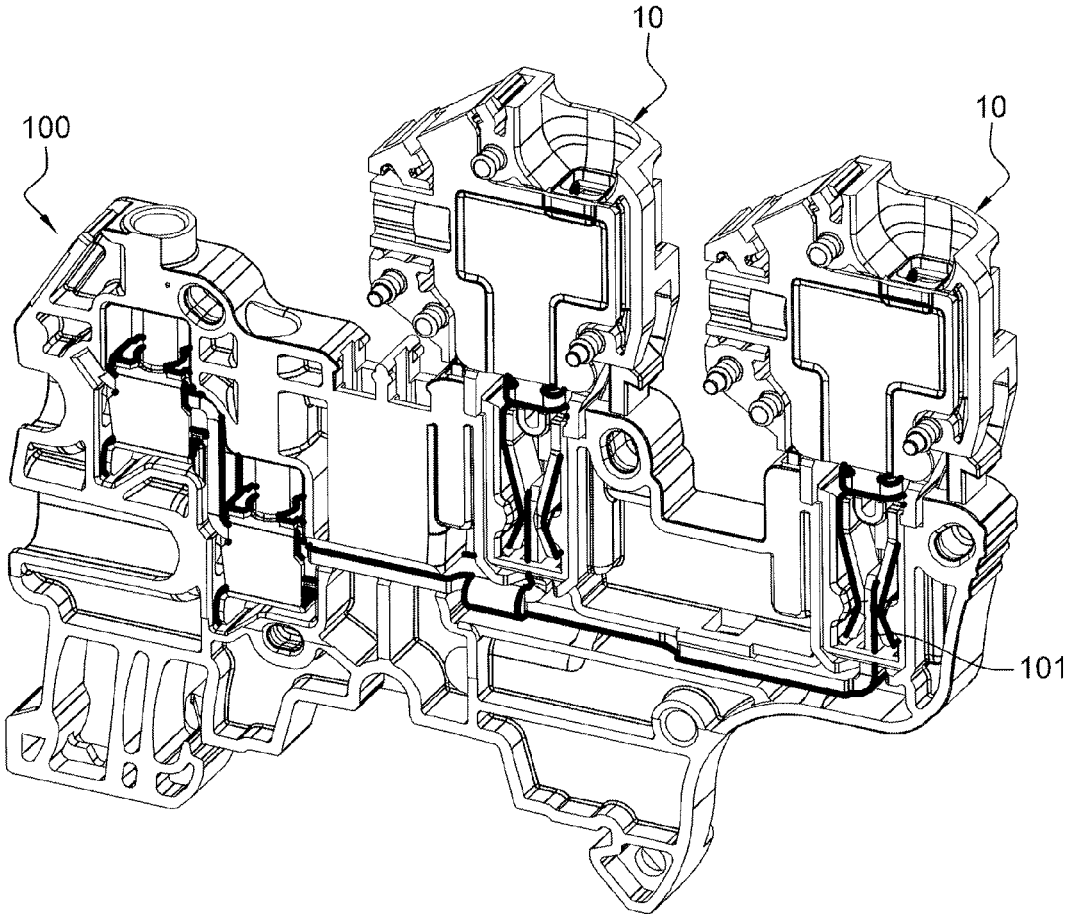
FIG. 4 shows a junction block on which two pluggable connectors of FIG. 2 are connected.

As illustrated in particular in FIGS. 1 and 2, an insulating body 1 according to the invention of a pluggable connector 10 intended to be connected to a junction block 100 comprises a housing 2 for conductive parts 11, 12.

The conductive parts 11, 12 include a connection terminal 11 intended to the connection of a conductive wire, and a connection socket 12 intended to the connection of a connection terminal 101 of a junction block 100, the connection terminal 11 being electrically linked to the connection socket 12 so as to allow the electrical linking between the conductive wire and the connection terminal 101 of the junction block 100.

The housing 2 opens on a side wall 3 of the insulating body 1 via an aperture 4 arranged on said side wall 3.

This aperture 4 allows in particular the insertion of the conductive parts 11, 12 in the housing 3.

Furthermore, the housing 3 comprises a support wall 5 on which many portions of the conductive parts 11, 12 are intended to bear inside the housing 3.

In particular, this support wall 5 includes a support portion 6 for the connection terminal 11 on which an electric wire is intended to be linked.

This support portion 6 presents a contour with a complementary shape to the contour of a portion of the connection terminal 11 intended to come into contact with said support portion 6.

Finally, the insulating body 1 comprises wedging means 7 of the connection terminal 11.

The wedging means 7 are disposed in part in a portion of the housing 2 situated facing the support portion 6 of the housing 2.

As with the support portion 6, the wedging means 7 present a contour with a complementary shape to the contour of a portion of the connection terminal 11 intended to come into contact with the wedging means 7.

In the presented example, the connection terminal 11 presents a cylindrical contour.

Thus, the support portion 6 presents a hemi-cylindrical shape as well as the wedging means 7.

Furthermore, in the presented example, the support portion 6 and the wedging means 7 present a shoulder 9 intended to maintain axially the connection terminal 11.

In the presented example, the wedging means 7 are removable but secured to a plate 20 with a determined thickness arranged to bear on a side wall 3 of the insulating body 1.

Of course, the wedging means 7 could be removable without necessarily being linked to a part of the insulating body 1.

In the presented example, the plate 20 is linked to an upper wall 8 adjacent to the side wall 3 of the insulating body via a linking element 21.

Thus, the wedging means 7 are movable between:

- a first position P1 wherein the wedging means 7 are disposed outside the housing 2 and the plate 20 is disposed at a distance from the side wall 3 of the insulating body 1, and
- a second position P2 wherein the wedging means 7 are disposed in part inside the housing 2 and the plate 20 bears on the side wall 3 of the insulating body 1.

The linking element 21 is linked to the upper wall 8 by a pivot link 22.

Furthermore, the linking element 21 presents a tenon 23 arranged to cooperate with a mortise 24 arranged on the upper wall 8 when the wedging means 7 are disposed in their second position P2.

Thus, the linking element 21 via the cooperation between the tenon 23 and the mortise 24 has also the function of guiding the movement of the plate 20 and enhancing the linking of the plate 20 on the upper wall 8.

However, the plate 20 comprises, on the face opposing the side wall 3 of the insulating body 1 when the wedging means 7 are brought to their second position P2, tenons 25 arranged to cooperate with mortises 26 disposed on the side wall 3 of the insulating body 1.

Thus, the cooperation between these tenons 25 and these mortises 26 allows in turn ensuring to maintain the wedging means 7 in their second position P2 and to maintain the plate 20 against the side wall 3 of the insulating body 1.

The plate 20 presents a determined thickness, to the extent that, when the wedging means 7 are placed in their second position P2 and that the plate 20 bears on the side wall 3 of the insulating body 1, then the plate 20 increases the pitch of the insulating body 1.

The thickness of the plate 20 is determined so as to catch up the pitch of junction block 100 on which the pluggable connector 10 is intended to be connected.

Thus, when assembling a first junction block 100 with a second junction block 100 then each pluggable connector 10 connected respectively to the first junction block 100 or to the second junction block 100 may bear on a pluggable connector 10 connected on a same raw of the other junction block 100.

In order to maintain therebetween two adjacent pluggable connectors 10, the side wall 3 of a pluggable connector 10 presents tenons 28 orientated in a direction opposite to the pluggable connector 10 and intended to cooperate with mortises disposed on another wall of the adjacent pluggable connector 10.

Each one of these tenons 28 is oversized to compensate for the thickness of the plate 20.

However, the plate 20 presents a contour 27 of which shape is arranged to pass around the tenons 28 protruding from the side wall 3 of the insulating body 1.

Nevertheless, it is possible to consider an embodiment wherein the plate 20 would include one or more aperture(s) for the passage of one or more tenon(s) 28 through the plate 20.

Although the invention was described in connection with particular embodiments, it remains clear that it is in no way limited and that it comprises all equivalent techniques for described means as well as their combinations.

The invention claimed is:

1. An insulating body for a pluggable connector configured to be connected to a junction block, said insulating body comprising:

a housing for conductive parts comprising a connection terminal for a conductive wire configured to be connected to the pluggable connector, said housing comprising a support portion for the connection terminal and being arranged to open on a side wall of the insulating body via an aperture arranged on said side wall, the insulating body comprising:

wedging means of the connection terminal, said wedging means presenting a hemi-cylindrical shape being disposed in whole or in part within a portion of the housing situated facing a hemi-cylindrical shape of the support portion of the housing, both hemi-cylindrical shapes arranged for cooperating with the connection terminal and said wedging means being secured to a plate of the insulating body with a determined thickness arranged to bear on the side wall of the insulating body, wherein the thickness of the plate is determined so as to catch up the pitch of the junction block on which the pluggable connector is configured to be connected, and tenons located on the side wall and orientated in a direction opposite the pluggable connector, the tenons configured to cooperate with mortises disposed on a wall of an adjacent pluggable connector.

2. The insulating body according to claim 1, wherein the wedging means are removable.

3. The insulating body according to claim 1, wherein the wedging means and the support portion of the housing present a contour with a determined shape configured to cooperate in a complementary way with a contour of the connection terminal.

4. The insulating body according to claim 1, wherein the plate is linked to an upper wall adjacent to the side wall of the insulating body via a linking element so as to be movable between:

a first position wherein the wedging means are disposed outside the housing and the plate is disposed at a distance from the side wall of the insulating body, and a second position wherein the wedging means are disposed in whole or in part within the housing and the plate bears on the side wall of the insulating body.

5. The insulating body according to claim 1, wherein the linking element is linked to the upper wall by a pivot link.

6. The insulating body according to claim 1, wherein the linking element comprises a tenon arranged to cooperate with a mortise disposed on the upper wall of the insulating body.

7. The insulating body according to claim 1, wherein the plate comprises at least one tenon arranged to cooperate with at least one mortise disposed on the side wall of the insulating body.

8. The insulating body according to claim 1, wherein the plate presents a contour of which shape is arranged to pass around the tenons protruding from the side wall of the insulating body.

9. A pluggable connector comprising an insulating body according to claim 1 and conductive parts including:

a connection terminal configured to the connection of a conductive wire, and a connection socket configured to the connection of a connection terminal of a junction block, the connection terminal being electrically linked to the connection socket.

* * * * *